United States Patent [19]

Huisingh et al.

[11] Patent Number: 5,040,104

[45] Date of Patent: Aug. 13, 1991

[54] TASK LIGHT PANEL

[75] Inventors: James H. Huisingh; Edward L. Elzinga, both of Holland, Mich.

[73] Assignee: Herman Miller, Inc., Zeeland, Mich.

[21] Appl. No.: 495,371

[22] Filed: Mar. 19, 1990

[51] Int. Cl.[5] ..... F21Y 5/08

[52] U.S. Cl. ..... 362/330; 362/333; 362/339

[58] Field of Search ..... 362/330, 333, 339, 331, 362/127, 147, 260, 33, 223, 311

[56] References Cited

U.S. PATENT DOCUMENTS

| | | | |
|---|---|---|---|
| 2,269,554 | 1/1942 | Rolph | 362/331 |
| 2,551,954 | 5/1951 | Lehman | 362/333 |
| 2,748,263 | 5/1956 | Franck et al. | 362/339 |
| 3,179,796 | 4/1965 | Rolph | 362/330 |
| 3,275,825 | 9/1966 | Welty | 362/330 |
| 4,054,793 | 10/1977 | Shemitz | 362/330 |
| 4,071,750 | 1/1978 | Schneppendahl et al. | 362/339 |
| 4,233,651 | 11/1980 | Fabbri | 362/331 |
| 4,242,723 | 12/1980 | Fabbri et al. | 362/331 |
| 4,254,449 | 3/1981 | Benasutti et al. . | |
| 4,300,185 | 10/1981 | Wakamatsu . | |
| 4,368,504 | 1/1983 | Sato et al. . | |
| 4,373,178 | 2/1983 | Gulliksen . | |
| 4,432,044 | 2/1974 | Lautzenheiser . | |
| 4,450,509 | 5/1984 | Henry . | |
| 4,542,449 | 9/1985 | Whitehead | 362/339 |
| 4,562,515 | 12/1985 | Lautzenheiser . | |
| 4,616,296 | 10/1986 | Westgaard et al. . | |
| 4,791,540 | 12/1988 | Dreyer, Jr. et al. . | |

FOREIGN PATENT DOCUMENTS

| | | | |
|---|---|---|---|
| 397205 | 4/1921 | Fed. Rep. of Germany . | |
| 450972 | 1/1913 | France | 362/330 |

*Primary Examiner*—Ira S. Lazarus
*Assistant Examiner*—Richard R. Cole
*Attorney, Agent, or Firm*—Varnum, Riddering, Schmidt & Howlett

[57] ABSTRACT

A task light panel for use with a light source for illuminating a work surface. The panel comprises an upper surface having a plurality of transverse grooves formed thereon and a lower surface having a plurality of longitudinal grooves formed thereon. The transverse and longitudinal grooves are substantially perpendicular to each other and are adapted to distribute light from the light source onto the work surface, reduce glare or veiling reflections from the work surface, and block direct viewing of the light source by an individual using the work surface.

39 Claims, 2 Drawing Sheets

TASK LIGHT PANEL

BACKGROUND OF THE INVENTION

1. Field of the Invention

The present invention relates to task lighting systems and, more particularly, to an improved means for evenly distributing light with reduced glare over an entire work surface using a single panel having integral lens and diffuser functions.

2. Description of the Related Art

Light from a linear source, such as a conventional fluorescent bulb mounted over a work surface, has an uneven illumination pattern. That is, the light is directed primarily to a center of the work surface, with greatly reduced illumination of the front, rear and sides of the work surface. Typically, a lens is employed to provide more uniform illumination across the work surface from one side to the other.

Strong coherent illumination also produces considerable glare off the work surface. Glare is undesirable because it causes fatigue, eye strain, and reduced user efficiency. In addition, direct light or glare from the bulb, such as caused by the user viewing the bulb, is very distracting and can cause fatigue.

Oftentimes a separate frosted diffuser sheet is employed to reduce glare by dispersing and attenuating light emanating from the light source. Frosted diffusers randomly diffuse light, thereby reducing glare or veiling reflections. However, because frosted diffusers randomly diffuse the light without attempting to focus it, they fail to adequately and uniformly illuminate the work surface from front to rear. Moreover, although frosted diffusers can prevent the user from viewing the bulb, a substantial amount of light still impinges on the user's eyes directly from the bulb. Further, the light is still reflected from a work surface to a user's eyes even though the light is diffused and attenuated.

Some diffusers employ prismatic refractors in an attempt to reduce glare and disperse light. An example of such an arrangement is disclosed in U.S. Pat. No. 4,233,651, issued Nov. 11, 1980 to W. Fabbri which discloses a lower refractor plate that is slidable laterally relative to an upper refractor plate. While light is dispersed toward opposite side portions of the work surface when the lower refractor plate is centered relative to the upper plate, only the central portion of the work surface is provided with glarefree light. The Fabbri structure is not adapted to prevent light from the source from directly impinging on the user's eyes or to prevent the source from being viewed by the user. The user can still view end portions of the light source. Further, the upper refractor plate increases the cost of the diffuser substantially.

U.S. Pat. No. 4,300,185 issued Nov. 10, 1981 to J. Wakamatsu discloses a structure in which the lighting fixture must be positioned above the front edge of the work surface. A control lens includes a plurality of pyramidal indentations formed adjacent to a front edge of and on an upper surface of the lens, the indentations being adapted to disperse light. The remainder of the upper surface is covered by a plurality of longitudinally extending linear indentations of nonuniform depth. However, the disclosed embodiments do not block direct viewing of the light source by a user or prevent light from directly impinging on the user's eyes.

Thus, there is a need for an improved task light panel that evenly disperses light over a work surface, reduces glare from the work surface, and effectively blocks the user's direct view of the light source. It would be advantageous if a single panel having these capabilities could be provided as this would reduce the production and assembly costs of a task lighting system.

SUMMARY OF THE INVENTION

The invention relates to a task light panel for use in conjunction with a light source for illuminating a work surface. The work surface has areas defined as a front portion and a rear portion. The panel includes an upper surface and a lower surface with the lower surface having an area defined as a front portion and another area defined as a rear portion. The upper surface has a plurality of first prisms. The lower surface front portion has a plurality of second prisms, and the lower surface rear portion is free of prisms. The first and second prisms are substantially perpendicular to one another and adapted to distribute light from the light source onto the work surface, enhancing the light on the work surface rear portion, and restricting the light beyond the work surface front portion.

The first prisms are formed on substantially the entire upper surface of the task light panel and are substantially symmetrical. Preferably, a side of each of the first prisms is disposed at an angle of approximately 40 degrees with respect to a line perpendicular to a face of the task light panel. The first prisms are adapted to substantially uniformly illuminate the work surface between the side edges thereof.

The second prisms are disposed on a portion of the lower surface of the task light panel. The panel typically also includes a front edge and a rear edge, and the second prisms are disposed on a portion of the lower surface adjacent the front edge. In one embodiment of the invention, the second prisms are disposed in an area bordered by the front edge and a line approximately midway between the front and rear edges. Preferably, the second prisms are asymmetrical and include side surfaces which are disposed at first and second angles with respect to a line perpendicular to a face of the panel. The first angle is preferably approximately 60 degrees, and the second angle is preferably approximately 10 degrees. The second set of prisms is adapted to direct light from the light source toward the rear edge of the work surface. The first prisms overlie the second prisms and cooperate with the second prisms to reduce glare or veiling reflections on the work surface as well as to block direct viewing of the light source by an individual using the work surface.

In another aspect of the invention, a task light panel is provided for use with a light source for illuminating a work surface having an edge. The panel includes a longitudinal axis, a first surface, and a second surface. The first surface has a plurality of symmetrical prisms substantially perpendicular to the longitudinal axis. The second surface preferably has a plurality of like asymmetrical prisms substantially parallel to the longitudinal axis, with the second surface having a portion thereof free of prisms. Thus, when the panel is disposed between the light source and the work surface and parallel to the work surface with the portion of the second surface free of prisms further from the edge than the portion of the second surface having prisms, light from the light source will be directed toward the work surface and away from the edge.

The invention also relates to a lighting fixture comprising a housing having an open bottom portion in which is received a light source, the housing being adapted to receive in the open bottom portion a task light panel constructed according to the invention. The invention further relates to a workstation in which a work surface and a storage module are mounted to a wall panel. A lighting fixture incorporating a task light panel constructed according to the invention can be mounted to the underside of the storage modular to illuminate the work surface below.

BRIEF DESCRIPTION OF THE DRAWINGS

For a more complete understanding of the invention reference should now be had to the accompanying drawings in which.

DETAILED DESCRIPTION OF THE PREFERRED EMBODIMENTS

Figure 1:
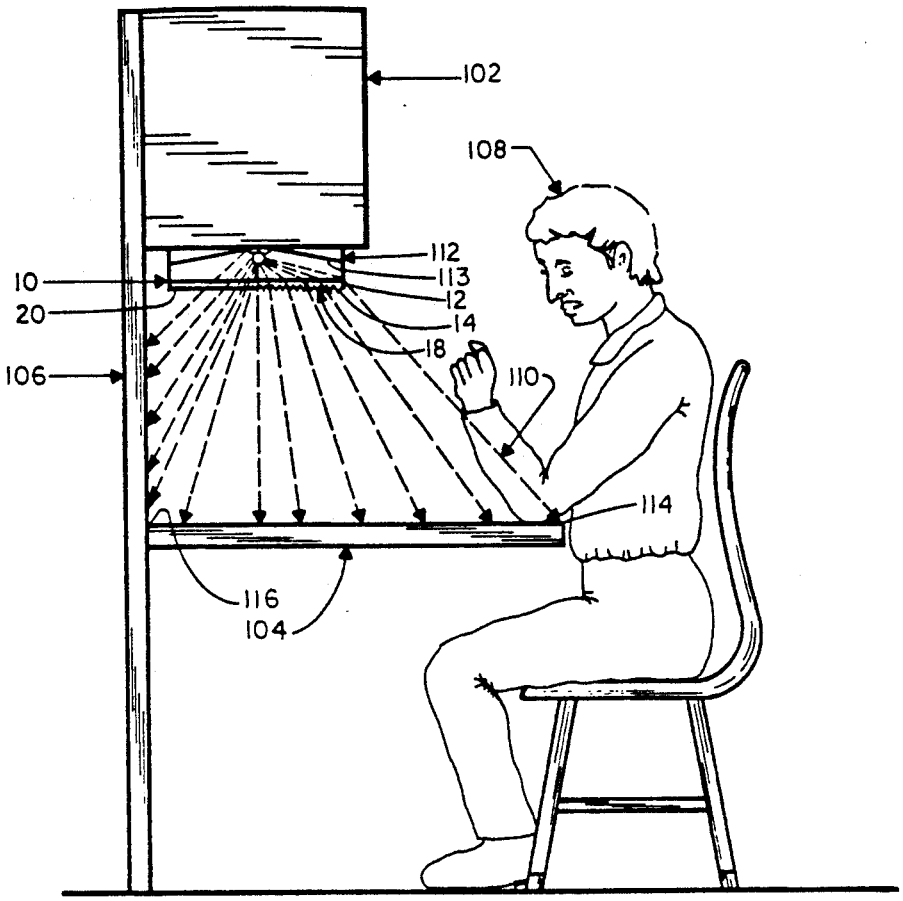
FIG. 1 is a side elevational view of an office work station incorporating a task light panel according to the invention.
Figure 2:
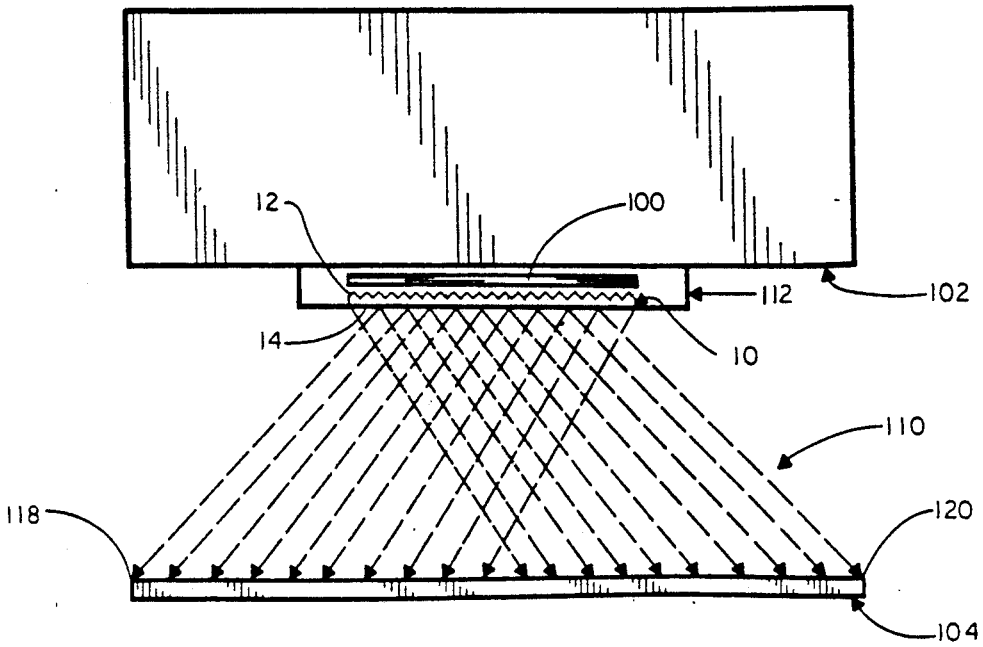
FIG. 2 is a front elevational view of an office work station incorporating the task light panel of FIG. 1.

Referring now to FIGS. 1 and 2, the task light panel is designated generally by the reference numeral 10 and is shown incorporated into a typical office work station 110. The work station 110 can form a part of a modular office arrangement of the open plan type that uses free-standing wall panels to segment space or can be provided in conjunction with a conventional office having structural partitions to which wall panels are mounted. Hanging components such as work surfaces, storage cabinets and shelves can be mounted to the wall panels in cantilevered fashion to furnish the work station 110.

FIGS. 1 and 2 show a work surface 104 and a storage module 102 such as a cabinet or shelf mounted to a wall panel 106 to furnish the work station 110. Task lighting is provided by a light fixture 112 mounted to an underside of the cabinet or shelf. Typically, the work surface 104 is rectangular with a longitudinal axis (not shown separately in the drawings) extending between a left side edge 118 of the work surface and a right side edge 120 of the work surface. The work surface further includes front and rear edges, respectively designated 114 and 116. For reference, the front edge 114 is that edge of the work surface which is typically adjacent a user 108 of the work surface. In the embodiment shown in FIG. 1, the work surface is cantilevered from the wall panel 106 so that the rear edge 116 thereof is adjacent to the wall panel. The work surface thus will have a front portion thereof extending toward the user 108 and a rear portion extending away from the user. Preferably, the fixture 112 is a sheet metal structure open at the bottom and having a linear light source 100 mounted therein. The fixture 112 includes means for mounting the task light panel 10. The task light panel 10 is mounted to the fixture 112 such that the task light panel is interposed between the light source 100 and the work surface 104. The light source 100 is, in the preferred arrangement, an elongated cylindrical element such as a conventional fluorescent T-12 bulb having a longitudinal axis (not shown separately in the drawings) parallel to the longitudinal axis of the work surface 104. An inside surface 113 of the fixture 112 is generally adapted to reflect light onto the work surface 104. As explained more fully below, the task light panel 10 directs light laterally across the work surface 104 (FIG. 2) and also away from eyes of a user 108 and onto the work surface (FIG. 1).

Figure 3:
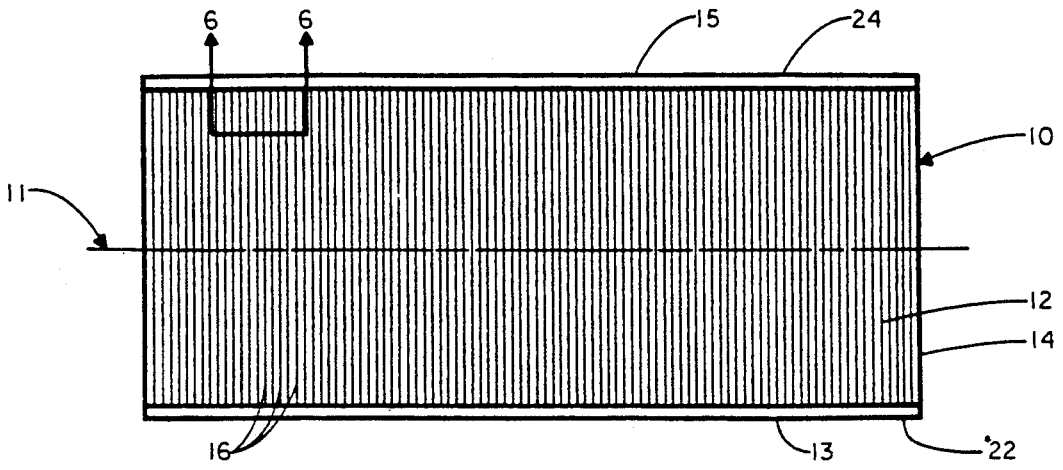
FIG. 3 is a top plan view of the task light panel of FIGS. 1 and 2.
Figure 4:
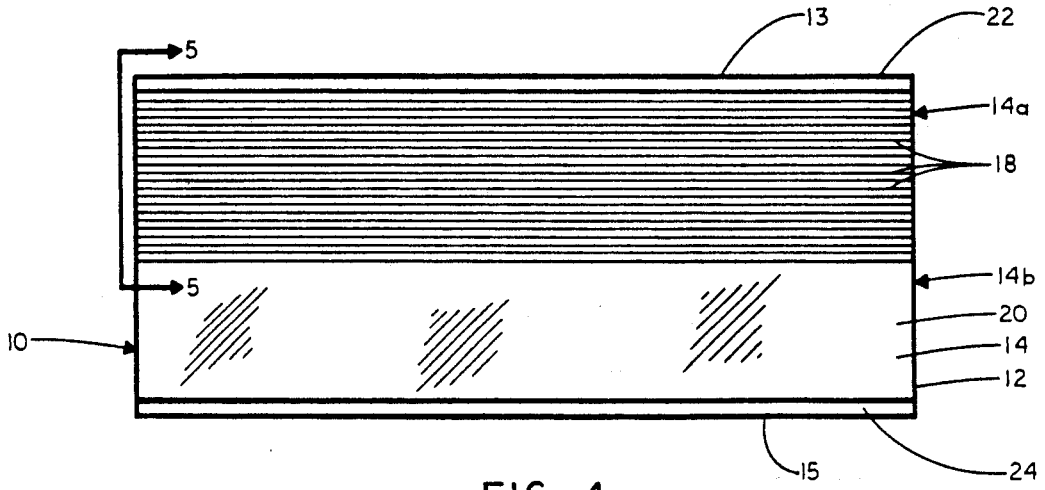
FIG. 4 is a bottom plan view of the task light panel of FIGS. 1 to 3.
Figure 5:
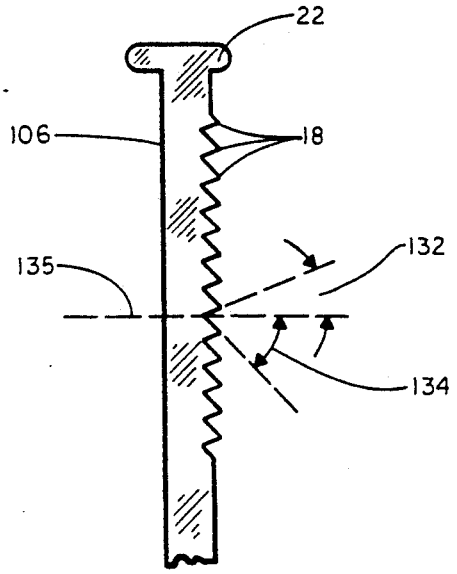
FIG. 5 is an enlarged, fragmentary, side elevational view taken generally along lines 5—5 of FIG. 4.

FIGS. 3 to 5 illustrate the structure of the task light panel 10 in greater detail The panel 10 is a generally rectangular, unitary sheet or member formed of a clear, light transmitting plastic such as acrylic. The panel 10 is horizontally mounted to the fixture 112 with a panel longitudinal axis 11 parallel to the longitudinal axes of the light source 100 and the work surface 104. The task light panel 10 includes an upper, light source facing surface 12 and a lower, work surface facing surface 14. A front lip 22 is formed along a front, user facing edge 13 of the task light panel 10. Similarly, a rear lip 24 is formed along a rear edge 15 of the panel 10. The front and rear lips 22, 24 provide rigidity to the panel 10 and can be used to mount the task light panel to the fixture 112.

Figure 6:
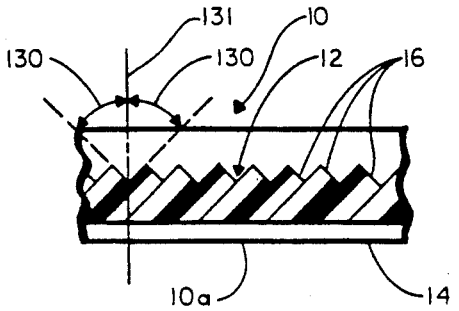
FIG. 6 is a sectional view of the task light panel taken generally along lines 6—6 of FIG. 3.

A plurality of substantially symmetrical transverse (or first) grooves 16 are formed on substantially the entire upper surface 12 of the panel 10, the grooves extending transversely to the longitudinal axis 11 of the task light panel. As best shown in FIG. 6, each groove 16 is prismatic in shape and is adapted to direct light from the light source 100 laterally across the work surface 104 (FIG. 2), thereby uniformly illuminating the work surface between the right and left work surface edges 118, 120. Thus, it will be seen that the structures formed between the grooves 16 are prisms which refract light from the light source as it passes through the panel 10. The degree of refraction depends upon the slope of the prism side or, conversely, the angle of the grooves. An optimum angle 130 for the transverse grooves 16 will vary depending upon the application for the panel 10; the material of construction for the panel; the configuration of the light source 100, the task light panel 10, and the fixture 112; and the position of the fixture with respect to the work surface. The angle 130 is preferably approximately 40 degrees with respect to a vertical center line (identified schematically by the reference numeral 131) perpendicular to a face 10*a* of the task light panel 10.

As best shown in FIGS. 4 and 5, the panel 10 further includes a plurality of asymmetrical longitudinal (or second) grooves 18 on a front portion 14*a* of the panel lower surface 14, and a smooth, grooveless section 20 on a rear portion 14*b* of the panel lower surface. The longitudinal grooves 18 extend parallel to the panel longitudinal axis 11 and occupy approximately one-half the lower surface depth, that is, the dimension extending between the panel front and rear edges 13, 15, respectively. (It will be understood that the longitudinal axis 11 of the panel 10 is identified principally for the purpose of describing the relative orientations of the transverse grooves 16 and the longitudinal grooves 18.) The area covered by the grooves 18 can be adjusted to adapt to particular needs. Each groove 18 is prismatic in shape and, as best shown in FIG. 1, is adapted to direct light emanating from the light source 100 away from the eyes of the user 108 and onto the work surface 104. As with the grooves 16 and prisms on the upper surface 12, so the grooves 18 define prisms on the lower surface 14 which refract light from the light source. The asymmetry of the grooves 18 means that opposite sides of the prisms will have different slopes. Thus, light will be refracted at different angles on the opposed sides of each prism. As can be seen in FIG. 5, each longitudinal groove 18 has a longitudinal groove front angle 132, which is significantly less than a longitudinal groove rear angle 134. The optimum dimension for the longitudinal groove front angle 132 and the longitudinal groove rear angle 134 will vary depending upon the application; the material of construction; the configuration of the light source 100, the task light panel 10, and the fixture 112; and the position of the fixture with respect to the work surface 104. Preferably, the longitudinal groove front angle 132 is approximately 10 degrees with respect to a vertical center line (identified schematically by the reference numeral 135) perpendicular to a face **10*b* of the panel and the longitudinal groove rear angle 134** is approximately 60 degrees with respect to the vertical center line.

As an example of a preferred embodiment, a task light panel having a dimension of approximately 44.5" in the longitudinal direction and a dimension of approximately 6.2" in the transverse direction is used in conjunction with a conventional T-12 fluorescent light source having a length or longitudinal dimension of approximately 36". The light source and task light panel are mounted to the underside of a storage cabinet and over a work surface. The work surface has a depth or transverse dimension of approximately 30", the light source is positioned approximately 8.6" from the work surface rear edge, and the panel is mounted in the range of 16.75" to 25.25" above the work surface.

In operation, the task light panel 10 performs several functions. The transverse grooves 16 on the upper surface 12 act as prismatic lenses to direct light toward the left and right work surface edges 118, 120 so that illumination of the work surface 104 is substantially uniform along the work surface longitudinal axis and glare to the user is avoided. The longitudinal grooves 18 on the lower surface 14 also act as prismatic lenses. They function principally to refract light from the source 100. In the absence of the grooves 18, illumination from the light source 100 would impinge directly on the eyes of the user 108 and would fall on the work surface 104 adjacent to the front edge 114 thereof. Thus, the longitudinal grooves 18 cooperate with the overlying transverse grooves 16 to provide increased illumination of the work surface 104 between the front and rear edges 114, 116. The grooves 16 and the grooves 18 also coact to block direct viewing of the light source 100 by the user 108. Thus the grooves 16 and the grooves 18, although forming independent prismatic lenses, cooperate synergistically to provide a diffuser function. It can be seen that a single task light panel that functions to uniformly illuminate a work surface between the side, front, and rear edges thereof has been provided. The panel further provides a diffuser function by reducing glare or veiling reflections from the work surface and blocking a user's direct view of the light source.

Reasonable variations or modifications are possible within the spirit of the foregoing specification and drawings without departing from the scope of the invention which is defined in the accompanying claims.

The embodiments of the invention in which an exclusive properly or privilege is claimed are defined as follows:

1. A task light panel for use with a light source for illuminating a work surface having a front portion and a rear portion, said panel comprising an upper surface and a lower surface, said lower surface having a front portion and a rear portion, said upper surface having a plurality of first prisms and said lower surface front portion having a plurality of second prisms, said lower surface rear portion being free of prisms, and said first and second prisms being substantially perpendicular to one another and adapted to distribute light from the light source onto the work surface, enhancing the light on the work surface rear portion, and restricting the light beyond the work surface front portion.

2. A task light panel according to claim 1, wherein said first prisms are disposed on substantially the entire upper surface.

3. A task light panel according to claim 2, wherein said first prisms are substantially symmetrical.

4. A task light panel according to claim 3, wherein a side of each of said first prisms is disposed at an angle of approximately 40 degrees with respect to a line perpendicular to a face of the task light panel.

5. A task light panel according to claim 4, wherein the work surface includes a pair of opposed side edges, said first prisms being adapted to substantially uniformly illuminate the work surface between the side edges, said panel being mounted a predetermined distance above the work surface.

6. A task light panel according to claim 4, wherein said second prisms are disposed on portion of said lower surface.

7. A task light panel according to claim 6, wherein said panel further includes a front edge and a rear edge and said second prisms one disposed on a portion of said lower surface adjacent to the front edge.

8. A task light panel according to claim 7, wherein said second prisms are disposed in an area bordered by the front edge and a line approximately midway between the front and rear edges.

9. A task light panel according to claim 6, wherein said second prisms are asymmetrical.

10. A task light panel according to claim 9, wherein said second prisms include side surfaces disposed at first and second angles, said first angles being approximately 60 degrees with respect to a line perpendicular to a face of the panel.

11. A task light panel according to claim 10, wherein said second angles are approximately 10 degrees with respect to a line perpendicular to the face of the panel.

12. A task light panel according to claim 11, wherein the work surface includes a front edge and a rear edge, said second set of prisms being adapted to direct light from the light source toward the rear edge of the work surface, said panel being mounted above the work surface a predetermined distance.

13. A task light panel according to claim 1, wherein said second prisms are formed on a portion of said lower surface.

14. A task light panel according to claim 13, wherein said panel further includes a front edge and a rear edge and said second prisms are disposed on a portion of said lower surface adjacent to the front edge.

15. A task light panel according to claim 14, wherein said second prisms are disposed in an area bordered by the front edge and a line approximately midway between the front and rear edges.

16. A task light panel according to claim 13, wherein said second prisms are asymmetrical.

17. A task light panel according to claim 16, wherein said second prisms include side surfaces disposed at first and second angles, said first angels being approximately 60 degrees with respect to a line perpendicular to a face of the panel.

18. A task light panel according to claim 17, wherein said second angles are approximately 10 degrees with respect to a line perpendicular to the face of the panel.

19. A task light panel according to claim 18, wherein the work surface includes a front edge and a rear edge, said second set of prisms being adapted to direct light from the light source toward the rear edge of the work surface, said panel being mounted above the work surface a predetermined distance.

20. A task light panel according to claim 1 wherein one of the first prisms and second prisms is defined by grooves.

21. A task light panel according to claim 1 wherein the second prisms substantially obscure view of the light source by a person using the work surface.

22. A task light panel according to claim 1 wherein one of the first and second prisms is formed integrally with the panel.

23. A task light panel according to claim 1 wherein one of the first and second prisms is defined by grooves formed in the panel.

24. A task light panel for use with a light source for illuminating a work surface having an edge, said panel including a longitudinal axis, a first surface, and a second surface, said first surface having a plurality of symmetrical prisms substantially perpendicular to the longitudinal axis, and said second surface having a plurality of like asymmetrical prisms substantially parallel to the longitudinal axis, said second surface having a portion thereof free of prisms whereby when the panel is disposed between the light source and the work surface and parallel to the work surface with the portion of the second surface free of prisms further from the edge than the portion of the second surface having prisms, light from the light source will be directed toward the work surface and away from the edge.

25. A task light panel according to claim 24, wherein the portion of said lower surface occupied by said asymmetrical prisms is approximately one-half the surface area of said lower surface.

26. A task light panel according to claim 25, wherein said symmetrical prisms include sides disposed at angles of approximately 40 degrees with respect to a line perpendicular to a face of said panel.

27. A task light panel according to claim 26, wherein asymmetrical prisms include sides disposed at first and second angles with respect to a line perpendicular to the face of said panel, said first angle being approximately 60 degrees and said second angle being approximately 10 degrees.

28. A task light panel according to claim 27, wherein the work surface includes opposed side edges and the symmetrical prisms are adapted to distribute light form the light source between the opposed side edges.

29. A task light panel according to claim 28, wherein the work surface further includes a front edge and a rear edge and the asymmetrical prisms are adapted to direct light from the light source toward the rear edge of the work surface, said panel being mounted above the work surface a predetermined distance.

30. A task light panel according to claim 24, wherein the symmetrical and the asymmetrical prisms cooperate to reduce veiling reflections on the work surface.

31. A task light panel according to claim 30, wherein the symmetrical and the asymmetrical prisms cooperate to block direct viewing of the light source by an individual utilizing the work station.

32. A lighting fixture for use in conjunction with a light source and a work surface, said fixture comprising a housing having an open bottom portion, said housing being adapted to mount a linear light source therein, said task light panel of claim 24 being received within the open bottom portion and mounted to said housing, between said light source and said work surface, said work surface being illuminated by said fixture.

33. A work station comprising a wall, a work surface mounted to the wall, a storage module mounted to the wall above the work surface, the lighting fixture of claim 32 mounted to an underside of the storage module and a predetermined distance above the work surface to illuminate the work surface.

34. A work station according to claim 33 wherein said work surface includes a pair of opposed side edges, said symmetrical prisms being adapted to substantially uniformly illuminate said work surface between the side edges, said panel being mounted a predetermined distance above said work surface.

35. A work station according to claim 34, wherein said work surface further includes a front edge and a rear edge, said asymmetrical prisms being adapted to direct light from the light source toward the rear edge of said work surface, said panel being mounted a predetermined distance above said work surface.

36. A task light panel for use with a light source for illuminating a work surface having an edge comprising:

first and second surfaces, said second surface having a terminal edge;

a plurality of substantially parallel first prisms on said first surface;

a plurality of substantially parallel second prisms on said second surface adjacent said terminal edge, a portion of said second surface away from said terminal edge being free of prisms, and said second prisms being substantially perpendicular relative to the first prisms, whereby when the panel is disposed between the light source and the work surface and parallel to the work surface with the portion of the second surface free of prisms further from the work surface edge than the portion having prisms, light form the light source will be directed toward the work surface and away from the work surface edge.

37. A task light panel for use with a light source for illuminating a work surface, said panel comprising:

an upper surface, a lower surface, a front edge, and a rear edge;

said upper surface having a plurality of first grooves formed thereon, said first grooves being substantially symmetrical and forming angles of approximately 40 degrees with respect to a line perpendicular to a face of the task light panel;

said lower surface having a plurality of second grooves formed on a portion thereof adjacent to the front edge, and disposed in an area bounded by the front edge and aligned approximately midway between the front and rear edges.

38. A task light panel for use with a light source for illuminating a work surface, said panel comprising an upper surface having a plurality of first grooves formed thereon and a lower surface having a plurality of second grooves formed on a portion of said lower surface adjacent to the front edge in a area bordered by the front edge and aligned approximately midway between the front and rear edges, said first and second grooves being substantially perpendicular to one another and adapted to distribute light from the light source onto the work surface.

39. A task light panel for use with a light source for illuminating a work surface, said panel including a longitudinal axis, an upper surface, a lower surface, a plurality of symmetrical grooves substantially perpendicular to the longitudinal axis formed on substantially the entire upper surface, and a plurality of asymmetrical grooves substantially parallel to the longitudinal axis formed on a portion of the lower surface, said portion being approximately one half of the surface area of said lower surface, and disposed adjacent an edge of said panel, another portion of said lower surface away from said edge being free of grooves.

* * * * *

UNITED STATES PATENT AND TRADEMARK OFFICE

CERTIFICATE OF CORRECTION

PATENT NO. : 5,040,104

DATED : August 13, 1991

INVENTOR(S) : JAMES H. HUISINGH and EDWARD L. ELZINGA

It is certified that error appears in the above-identified patent and that said Letters Patent is hereby corrected as shown below:

Claim 7, column 6, line 34:
"one" should be --are--;

Claim 17, column 7, line 3:
"angels" should be --angles--;

Claim 28, column 7, line 58:
"form" should be --from--.

Signed and Sealed this

Second Day of March, 1993

*Attest:*

STEPHEN G. KUNIN

*Attesting Officer*

*Acting Commissioner of Patents and Trademarks*